US007168478B2

(12) United States Patent
Edwards et al.

(10) Patent No.: US 7,168,478 B2
(45) Date of Patent: Jan. 30, 2007

(54) METHOD OF MAKING THIN CAST STRIP USING TWIN-ROLL CASTER AND APPARATUS THEREFOR

(75) Inventors: Jim Edwards, Lafayette, IN (US); Walter N. Blejde, Brownsburg, IN (US)

(73) Assignee: Nucor Corporation, Charlotte, NC (US)

( * ) Notice: Subject to any disclaimer, the term of this patent is extended or adjusted under 35 U.S.C. 154(b) by 0 days.

(21) Appl. No.: 11/168,744

(22) Filed: Jun. 28, 2005

(65) Prior Publication Data

US 2006/0289142 A1 Dec. 28, 2006

(51) Int. Cl.
*B22D 11/06* (2006.01)

(52) U.S. Cl. ..... 164/480; 164/428

(58) Field of Classification Search ..... 164/428, 164/480

See application file for complete search history.

(56) References Cited

U.S. PATENT DOCUMENTS

| | | | | |
|---|---|---|---|---|
| 4,700,312 | A | 10/1987 | Kikuma et al. | |
| 4,940,076 | A | 7/1990 | Desautels et al. | |
| 5,031,688 | A | 7/1991 | Burgo et al. | |
| 5,372,180 | A * | 12/1994 | Grocock et al. | 164/452 |
| 5,626,183 | A | 5/1997 | Romanowski et al. | |
| 5,636,543 | A | 6/1997 | Kajiwara et al. | |
| 5,706,882 | A | 1/1998 | Fellus et al. | |
| 5,927,375 | A * | 7/1999 | Damasse et al. | 164/451 |
| 5,950,476 | A | 9/1999 | Brashear | |
| 6,129,136 | A | 10/2000 | Tibbs et al. | |
| 6,301,946 | B1 | 10/2001 | Kukizaki et al. | |
| 6,474,403 | B1 | 11/2002 | Nikolovski et al. | |
| 6,604,569 | B1 * | 8/2003 | Nikolovski et al. | 164/428 |
| 6,766,934 | B1 | 7/2004 | Ziegelaar et al. | |

FOREIGN PATENT DOCUMENTS

| | | |
|---|---|---|
| DE | 42 08 490 | 9/1993 |
| EP | 0 726 112 | 8/1996 |
| EP | 0 903 187 | 3/1999 |
| JP | 01148412 | 6/1989 |
| JP | 2-55652 | 2/1990 |

(Continued)

OTHER PUBLICATIONS

International Search Report for PCT/AU2006/00272.

(Continued)

*Primary Examiner*—Kuang Y. Lin
(74) *Attorney, Agent, or Firm*—Hahn Loeser & Parks LLP; Arland T. Stein

(57) ABSTRACT

A system and method for producing thin cast strip by continuous casting is disclosed. The system includes a twin-roll casting apparatus having a pair of casting rolls positioned laterally adjacent each other to form a nip between the casting rolls through which metal strip may be continuously cast. A drive mechanism of the system is capable of individually driving the rotational speed of the casting rolls in a counter-rotational direction to cause the strip to pass through the nip between the casting rolls. A control mechanism of the system is capable of varying an alignment angle between the casting rolls to reduce effects of eccentricity in the casting rolls on a profile of the strip produced by the casting rolls.

9 Claims, 7 Drawing Sheets

FOREIGN PATENT DOCUMENTS

| | | |
|---|---|---|
| JP | 05-138249 | 6/1993 |
| JP | 07-116724 | 5/1995 |
| JP | 07-256327 | 10/1995 |
| JP | 08-090063 | 4/1996 |
| JP | 08-206790 | 8/1996 |
| JP | 08-215814 | 8/1996 |
| JP | 10-005808 | 1/1998 |
| JP | 11-347616 | 12/1999 |
| JP | 2000-263120 | 9/2000 |
| JP | 2001-220642 | 8/2001 |
| JP | 2001-246401 | 9/2001 |
| JP | 2002-336909 | 11/2002 |
| JP | 2003-154441 | 5/2003 |
| WO | 92/01524 | 2/1992 |

OTHER PUBLICATIONS

Written Opinion for PCT/AU2006/00272.
International Search Report for PCT/AU2006/000895.
Written Opinion for PCT/AU2006/000895.

* cited by examiner

METHOD OF MAKING THIN CAST STRIP USING TWIN-ROLL CASTER AND APPARATUS THEREFOR

BACKGROUND AND SUMMARY OF THE INVENTION

In a twin roll caster, molten metal is introduced between a pair of counter-rotated horizontal casting rolls which are cooled so that metal shells solidify on the moving roll surfaces, and are brought together at the nip between them to produce a solidified strip product delivered downwardly from the nip between the casting rolls. The term "nip" is used herein to refer to the general region at which the casting rolls are closest together. The molten metal may be poured from a ladle through a metal delivery system comprised of a tundish and a core nozzle located above the nip to form a casting pool of molten metal supported on the casting surfaces of the rolls above the nip and extending along the length of the nip. This casting pool is usually confined between refractory side plates or dams held in sliding engagement with the end surfaces of the rolls so as to dam the two ends of the casting pool against outflow.

When casting steel strip in a twin roll caster, the strip leaves the nip at very high temperatures on the order of 1400° C. or higher. If exposed to normal atmosphere, it would suffer very rapid scaling due to oxidation at such high temperatures. Therefore, a sealed enclosure is provided beneath the casting rolls to receive the hot strip and through which the strip passes away from the strip caster, the enclosure containing an atmosphere which inhibits oxidation of the strip. The oxidation inhibiting atmosphere may be created by injecting a non-oxidizing gas, for example, an inert gas such as argon or nitrogen, or combustion exhaust gases which may be reducing gases. Alternatively, the enclosure may be sealed against ingress of oxygen containing atmosphere during operation of the strip caster. The oxygen content of the atmosphere within the enclosure is then reduced during an initial phase of casting by allowing oxidation of the strip to extract oxygen from the sealed enclosure as disclosed in U.S. Pat. Nos. 5,762,126 and 5,960,855.

In twin roll casting, eccentricities in the casting rolls can lead to strip thickness variations along the strip. Such eccentricities can arise either due to machining and assembly of the rolls, or due to distortion and wear when the rolls are hot possibly due to non-uniform heat flux distribution. Specifically, each revolution of the casting rolls will produce a pattern of thickness variations dependent on eccentricities in the rolls, and this pattern will be repeated for each revolution of the casting rolls. Usually the repeating pattern will be generally sinusoidal, but there may be secondary or tertiary fluctuations within the generally sinusoidal patter. In accordance with embodiments of the present invention, these repeated thickness variations can be reduced significantly by individually driving the rotation of the casting rolls and adjusting the angular phase relationship between the rotation of the casting rolls to reduce the effect of the eccentricity in the rolls on the variation in profile of the cast strip. One way of compensating for this problem is described in U.S. Pat. No. 6,604,569, issued Aug. 12, 2003.

Described herein is a method of producing thin cast strip by continuous casting that comprises the steps of:

(a) assembling a twin-roll caster having a pair of casting rolls forming a nip between the casting rolls;

(b) assembling a drive system for the twin-roll caster capable of individually driving the casting rolls and maintaining an alignment angle between the casting rolls;

(c) assembling a metal delivery system capable of forming a casting pool between the casting rolls above the nip and having side dams adjacent an end of the nip to confine the casting pool;

(d) introducing molten metal between the pair of casting rolls to form a casting pool supported on casting surfaces of the casting rolls and confined by the side dams;

(e) counter-rotating the casting rolls to form solidified metal shells on the surfaces of the casting rolls and to cast strip from the solidified shells through the nip between the casting rolls; and (f) modifying the alignment angle between the rotating casting rolls such that eccentricities between the casting rolls are reduced to form cast strip having a more uniform thickness.

In addition, sensors may be provided which are capable of sensing eccentricities in casting surfaces of at least one of the casting rolls and generating electrical signals indicating variation in such eccentricities of the casting roll(s). Also, a controller is provided which is capable of varying the alignment angle in rotation to reduce a variation in shape of the strip due to the eccentricities in the casting rolls.

Also described as part of the invention is a twin-roll casting apparatus for producing thin cast strip that comprises:

(a) a pair of casting rolls positioned laterally adjacent each other to form a nip between the casting rolls through which metal strip may be continuously cast;

(b) a drive mechanism for the casting rolls capable of individually driving the rotational speed of the casting rolls in a counter-rotational direction to cause the strip to pass through the nip between the casting rolls; and (c) a control mechanism capable of varying an alignment angle in rotation between the casting rolls to reduce the effect of eccentricities in the casting rolls on the profile of the strip produced by the casting rolls.

In addition, the twin-roll casting apparatus comprises sensors capable of sensing eccentricities in the casting surfaces of the casting rolls and generating electrical signals indicating variations in eccentricity in the casting surfaces of at least one, and typically both, of the casting rolls. The control mechanism is capable of varying the alignment angle in rotation between the casting rolls to automatically reduce effects on the profile of the strip from the eccentricities in the casting rolls in response to the electrical signals.

Other details, objects and advantages of the invention will be apparent from the following description of particularly presently contemplated embodiments of the invention proceeds.

BRIEF DESCRIPTION OF THE DRAWINGS

The operation of an illustrative twin roll casting plant in accordance with an embodiment of the present invention is described with reference to the accompanying drawings, in which.

DESCRIPTION OF THE PREFERRED EMBODIMENTS

Figure 1:
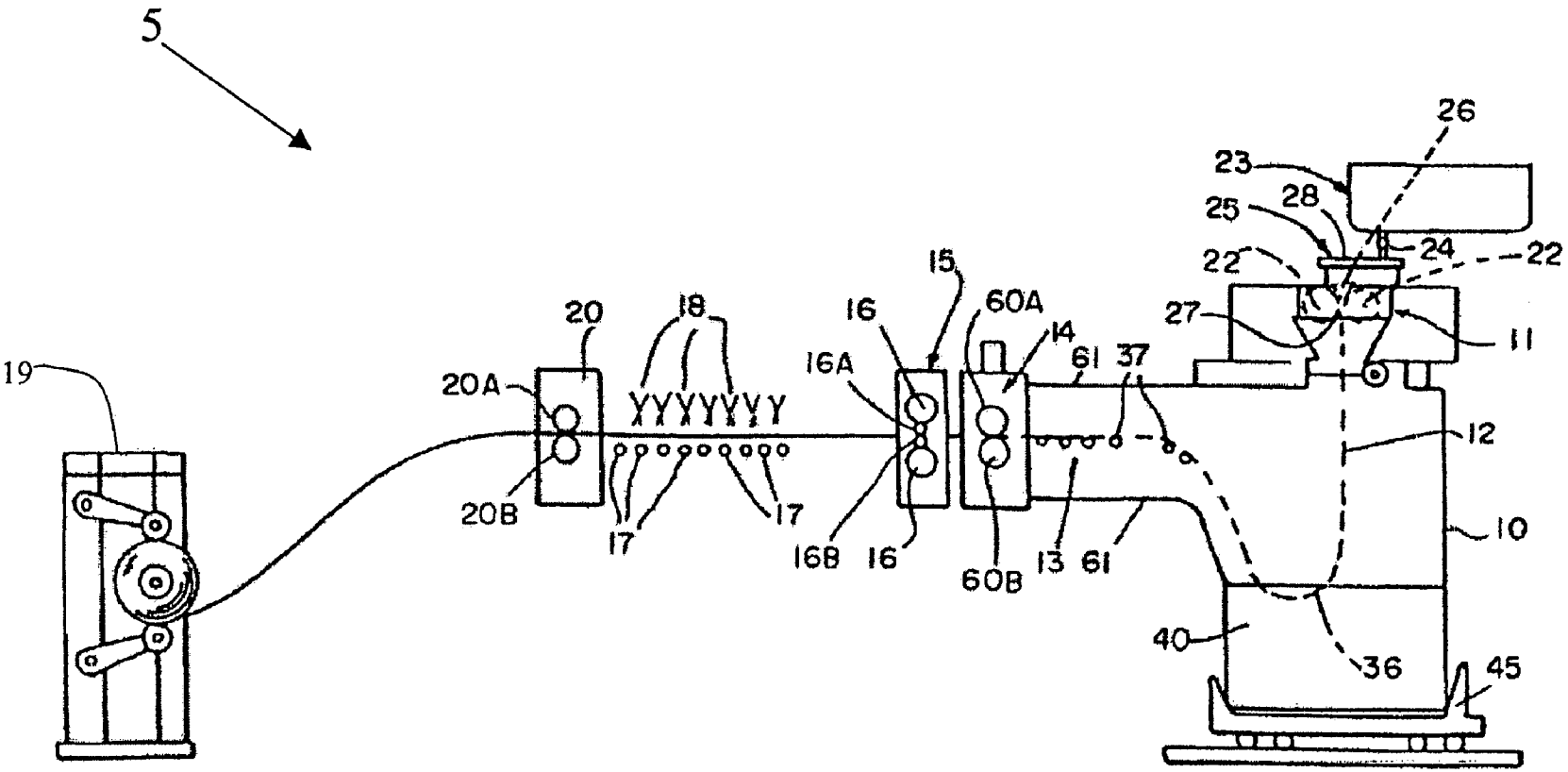
FIG. 1 is a schematic drawing illustrating a thin strip casting plant, in accordance with an embodiment of the present invention.

FIG. 1 is a schematic drawing illustrating a thin strip casting plant 5, in accordance with an embodiment of the present invention. The illustrated casting and rolling installation comprises a twin-roll caster denoted generally by 11 which produces thin cast steel strip 12. Thin cast steel strip 12 passes downwardly and then into a transient path across a guide table 13 to a pinch roll stand 14. After exiting the pinch roll stand 14, thin cast strip 12 may optionally pass into and through hot rolling mill 15 comprised of back up rolls 16 and upper and lower work rolls 16A and 16B, where the thickness of the strip may be reduced. The strip 12, upon exiting the rolling mill 16, passes onto a run out table 17, where it may be forced cooled by water jets 18, and then through pinch roll stand 20, comprising a pair of pinch rolls 20A and 20B, and then to a coiler 19, where the strip 12 is coiled, for example, into 20 ton coils.

Figure 2:
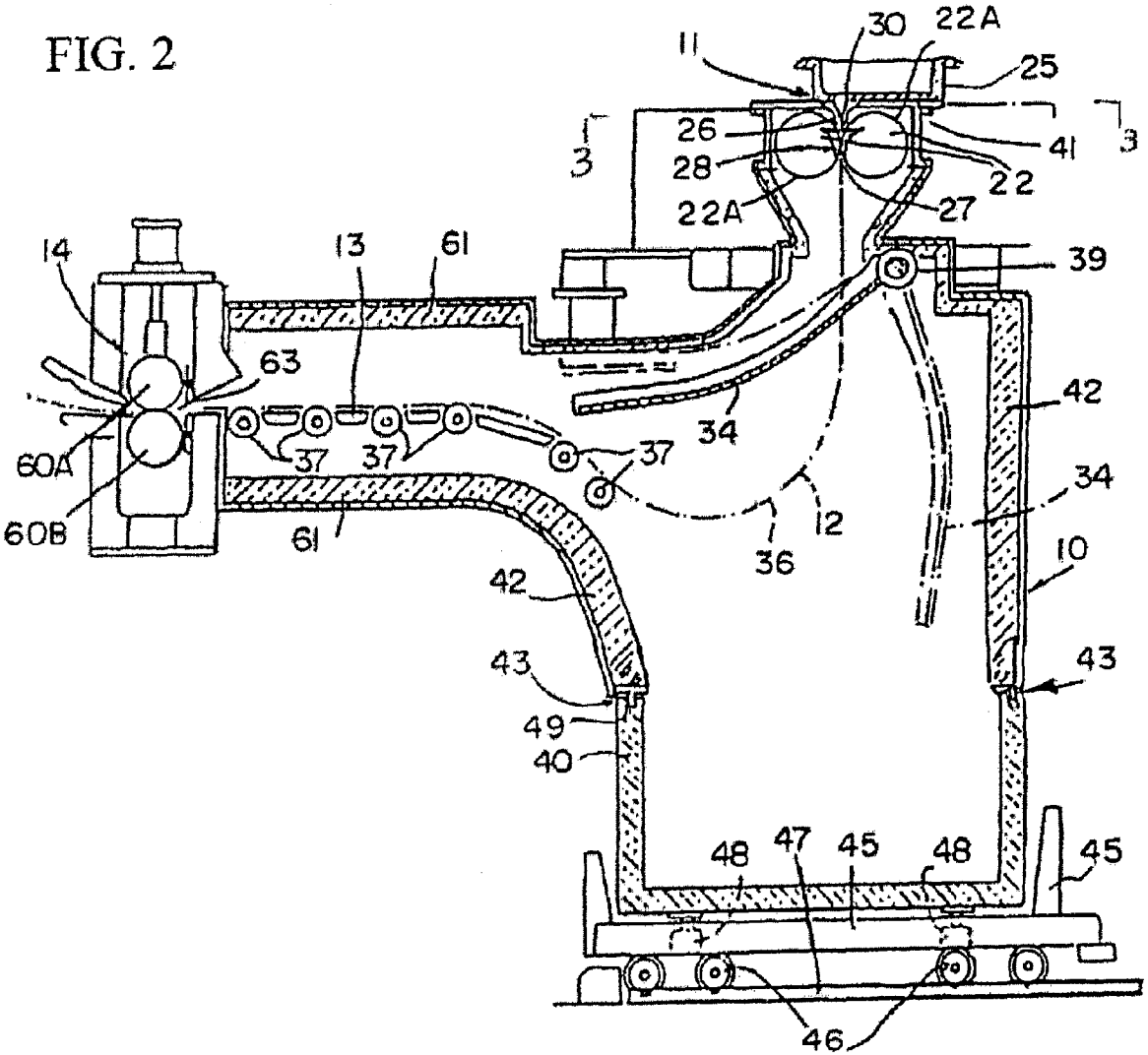
FIG. 2 is an enlarged cut-away side view of the twin caster of the thin strip casting plant of FIG. 1.

FIG. 2 is an enlarged cut-away side view of the twin caster 11 of the thin strip casting plant 5 of FIG. 1. Twin-roll caster 11 comprises a pair of laterally positioned casting rolls 22 having casting surfaces 22A, and forming a nip 27 between them. Molten metal is supplied during a casting campaign from a ladle (not shown) to a tundish 23, through a refractory shroud 24 to a removable tundish 25 (also called distributor vessel or transition piece), and then through a metal delivery nozzle 26 (also called a core nozzle) between the casting rolls 22 above the nip 27. Removable tundish 25 is fitted with a lid 28. The tundish 23 is fitted with a stopper rod and a slide gate valve (not shown) to selectively open and close the outlet from shroud 24, to effectively control the flow of molten metal from the tundish 23 to the caster. The molten metal flows from removable tundish 25 through an outlet and usually to and through delivery nozzle 26.

Molten metal thus delivered to the casting rolls 22 forms a casting pool 30 above nip 27 supported by casting roll surfaces 22A. This casting pool is confined at the ends of the rolls by a pair of side dams or plates 28, which are applied to the ends of the rolls by a pair of thrusters (not shown) comprising hydraulic cylinder units connected to the side dams. The upper surface of the casting pool 30 (generally referred to as the "meniscus" level) may rise above the lower end of the delivery nozzle 26 so that the lower end of the deliver nozzle is immersed within the casting pool.

Casting rolls 22 are internally water cooled by coolant supply (not shown) and driven in counter-rotational direction by driving mechanisms (not shown in FIG. 1 or FIG. 2) so that shells solidify on the moving casting roll surfaces 22A and are brought together at the nip 27 to produce the thin cast strip 12, which is delivered downwardly from the nip between the casting rolls.

Below the twin roll caster 11, the cast steel strip 12 passes within sealed enclosure 10 to the guide table 13, which guides the strip to pinch roll stand 14, through which it exits sealed enclosure 10. The seal of the enclosure 10 may not be complete, but is appropriate to allow control of the atmosphere within the enclosure and of access of oxygen to the cast strip within the enclosure as hereinafter described. After exiting the sealed enclosure 10, the strip 12 may pass through further sealed enclosures (not shown) after the pinch roll stand 14.

Enclosure 10 is formed by a number of separate wall sections which fit together at various seal connections to form a continuous enclosure wall. As shown in FIG. 2, these sections comprise a first wall section 41 at the twin roll caster 11 to enclose the casting rolls 22, and a wall enclosure 42 extending downwardly beneath first wall section 41 to form an opening that is in sealing engagement with the upper edges of a scrap box receptacle 40. A seal 43 between the scrap box receptacle 40 and the enclosure wall 42 may be formed by a knife and sand seal around the opening in enclosure wall 42, which can be established and broken by vertical movement of the scrap box receptacle 40 relative to enclosure wall 42. More particularly, the upper edge of the scrap box receptacle 40 may be formed with an upwardly facing channel which is filled with sand and which receives a knife flange depending downwardly around the opening in enclosure wall 42. Seal 43 is formed by raising the scrap box receptacle 40 to cause the knife flange to penetrate the sand in the channel to establish the seal. This seal 43 may be broken by lowering the scrap box receptacle 40 from its operative position, preparatory to movement away from the caster to a scrap discharge position (not shown).

Scrap box receptacle 40 is mounted on a carriage 45 fitted with wheels 46 which run on rails 47, whereby the scrap box receptacle 40 can be moved to the scrap discharge position. Carriage 45 is fitted with a set of powered screw jacks 48 operable to lift the scrap box receptacle 40 from a lowered position, where it is spaced from the enclosure wall 42, to a raised position where the knife flange penetrates the sand to form seal 43 between the two.

Sealed enclosure 10 further may have a third wall section disposed 61 about the guide table 13 and connected to the frame 67 of pinch roll stand 14, which supports a pair of pinch rolls 60A and 60B in chocks 62 as shown in FIG. 2. The third wall section disposed 61 of enclosure 10 is sealed by sliding seals 63.

Most of the enclosure wall sections 41, 42 and 61 may be lined with fire brick. Also, scrap box receptacle 40 may be lined either with fire brick or with a castable refractory lining.

In this way, the complete enclosure 10 is sealed prior to a casting operation, thereby limiting access of oxygen to thin cast strip 12, as the strip passes from the casting rolls 22 to the pinch roll stand 14. Initially the strip 12 can take up the oxygen from the atmosphere in enclosure 10 by forming heavy scale on an initial section of the strip. However, the sealing enclosure 10 limits ingress of oxygen into the enclosure atmosphere from the surrounding atmosphere to limit the amount of oxygen that could be taken up by the strip 12. Thus, after an initial start-up period, the oxygen content in the atmosphere of enclosure 10 will remain depleted, so limiting the availability of oxygen for oxidation of the strip 12. In this way, the formation of scale is controlled without the need to continuously feed a reducing or non-oxidizing gas into the enclosure 10.

Of course, a reducing or non-oxidizing gas may be fed through the walls of enclosure 10. However, in order to avoid the heavy scaling during the start-up period, the enclosure 10 can be purged immediately prior to the commencement of casting so as to reduce the initial oxygen level within enclosure 10, thereby reducing the time period for the oxygen level to stabilize in the enclosure atmosphere as a result of the interaction of the oxygen in oxidizing the strip passing through it. Thus, illustratively, the enclosure 10 may conveniently be purged with, for example, nitrogen gas. It has been found that reduction of the initial oxygen content to levels of between 5% and 10% will limit the scaling of the strip at the exit from the enclosure 10 to about 10 microns to 17 microns even during the initial start-up phase. The oxygen levels may be limited to less than 5%, and even 1% and lower, to further reduce scale formation on the strip 12.

At the start of a casting campaign a short length of imperfect strip is produced as the casting condition stabilizes. After continuous casting is established, the casting rolls 22 are moved apart slightly and then brought together, again to cause this leading end of the strip to break away in the manner described in Australian Patent 646,981 and U.S. Pat. No. 5,287,912, to form a clean head end of the following thin cast strip 12. The imperfect material drops into scrap box receptacle 40 located beneath caster 11, and at this time swinging apron 34, which normally hangs downwardly from a pivot 39 to one side of the caster as shown in FIG. 2, is swung across the caster outlet to guide the clean end of thin cast strip 12 onto the guide table 13, where the strip is fed to pinch roll stand 14. Apron 34 is then retracted back to its hanging position as shown in FIG. 2, to allow the strip 12 to hang in a loop 36 beneath the caster as shown in FIGS. 1 and 2 before the strip passes onto the guide table 13. The guide table 13 comprises a series of strip support rolls 37 to support the strip before it passes to the pinch roll stand 14. The rolls 37 are disposed in an array extending from the pinch roll stand 14 backwardly beneath the strip 12 and curve downwardly to smoothly receive and guide the strip from the loop 36.

The twin-roll caster may be of a kind which is illustrated and described in detail in U.S. Pat. No. 5,184,668 and 5,277,243, or U.S. Pat. No. 5,488,988. Reference may be made to these patents for construction details, which are not part of the present invention.

Figure 3:
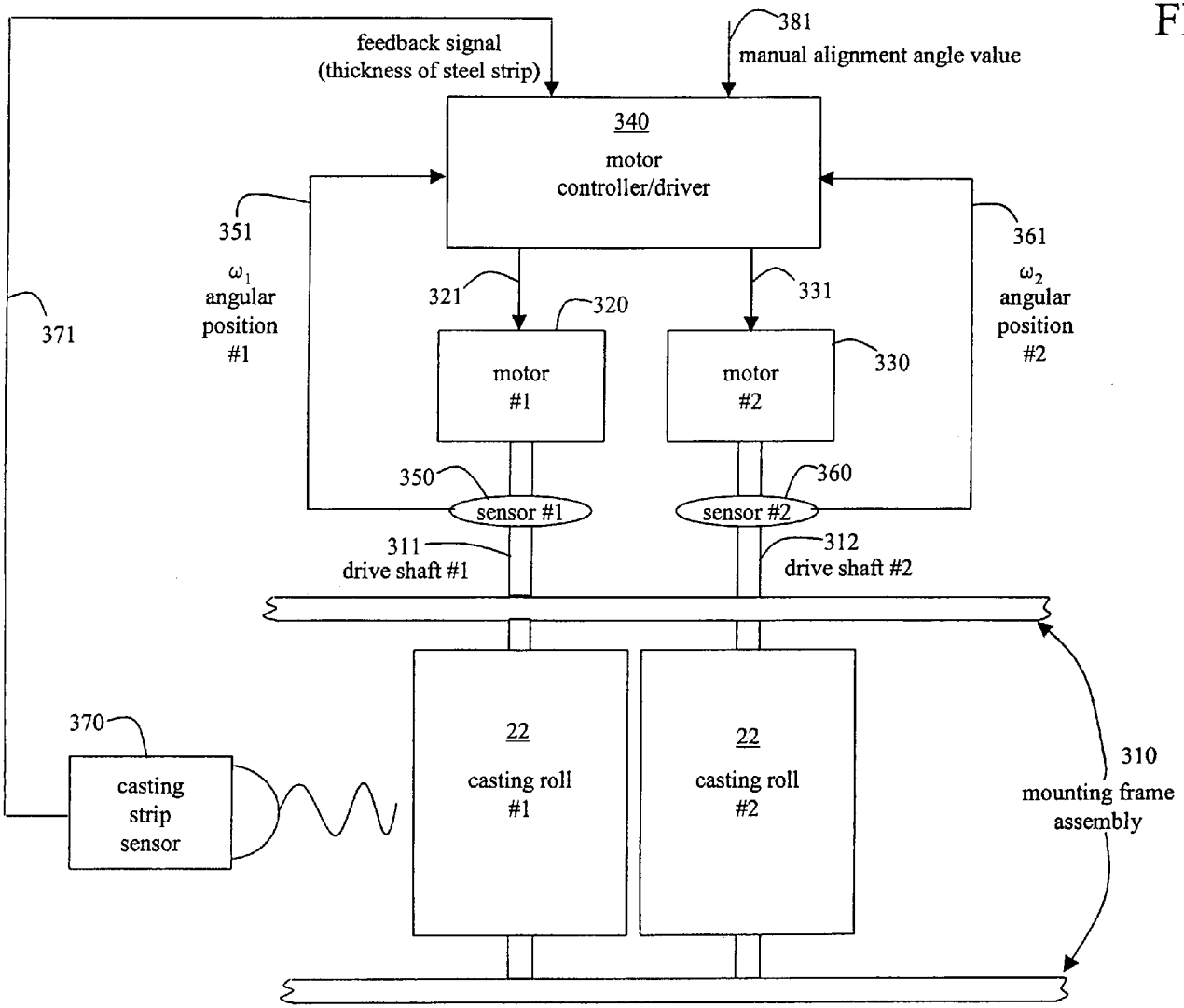
FIG. 3 is a schematic block diagram showing an exemplary embodiment of a twin-roll casting apparatus showing the casting rolls of the twin-roll caster of FIG. 1 and FIG. 2 with separate drive capability for each roll.

FIG. 3 is a schematic block diagram showing an embodiment of a twin-roll casting apparatus showing the casting rolls 22 of the twin roll caster 11 of FIG. 1 and FIG. 2 with separate, individual drives for each casting roll. The casting rolls 22 are mounted on a frame assembly 310 and are connected to drive shafts 311 and 312. Drive shaft 311 is driven by motor 320 and drive shaft 312 is driven by motor 330. The motors 320 and 330 are driven by signals from a motor controller/driver mechanism 340. The motor controller/driver mechanism 340 provides 3-phase AC current signals 321 and 331 (i.e., independent drive signals) to the motors 320 and 330, respectively, to torque the motors 320 and 330, in accordance with an embodiment of the present invention. Therefore, the motors 320 and 330 may be 3-phase AC motors. Other types of motors (e.g., DC motors) may also be used when desired.

In accordance with an alternative embodiment of the present invention, a single power source (e.g., a single motor) may be provided (instead of two motors) which is connected to an appropriate transmission which allows each casting roll to effectively be individually driven or controlled.

Sensors 350 and 360 sense the angular rotational position $\omega_1$ and $\omega_2$ of each of the drive shafts 311 and 312 respectively with respect to some predefined reference and, in turn, of each of the casting rolls 22 (casting roll #1 and casting roll #2) respectively. Electrical signals 351 and 361 from the sensors 350 and 360 are fed back to the motor controller/driver mechanism 340 and are used to help maintain angular alignment of the casting rolls 22 as they counter-rotate and to correct for eccentricities in the casting rolls 22 as described later herein. In accordance with an embodiment of the present invention, sensors 350 and 360 comprise high-resolution angular encoders.

A casting strip sensor 370 is used to sense the variations in the thickness profile of the casting strip 12 as it moves away from the nip 27 between the casting rolls 22, or to sense variations in the surface of at least one of the casting rolls themselves. The sensor 370 feeds back an electrical signal 371 to the motor controller/driver mechanism 340 and is a measure of the time-varying thickness of the casting strip 12 (or eccentricities in the surface of at least one of the casting rolls with respect to some reference such as, for example, a measurement of the casting surfaces at the beginning of the casting process). The electrical signal 371 is used along with the electrical signals 351 and 361 to correct for eccentricities in the casting rolls 22 as described later herein. In accordance with certain embodiments of the present invention, the casting strip sensor 370 may comprise an X-ray sensor, an ultrasonic sensor, or any other type of sensor capable of measuring variation in thickness in the casting strip 12 and/or roundness/surface variations of the casting rolls. However, measuring the thickness of the strip is believed a more accurate measure. Also, the casting strip sensor 370 may be positioned further down stream in the casting plant 5 at, for example, the output of the pinch roll stand 14, or other positions.

In accordance with one embodiment, a manual alignment angle value 381 may be fed into the motor controller/driver mechanism 340 to provide an initial desired alignment angle (0 to 360 degrees) between the two casting rolls 22. For example, if an angle of 30 degrees is desired, such a value may be input as the manual alignment angle value 381. As a result, the casting rolls 22 will be offset from each other in angle by 30 degrees as they counter-rotate. The motor controller/driver mechanism 340 will try to maintain the input alignment angle of 30 degrees as the casting rolls 22 counter-rotate with respect to each other, unless the feedback signal 371 indicates during operation that the alignment angle should be changed in order to reduce the effects of eccentricities in the casting rolls 22 on the casting strip 12.

Figure 4:
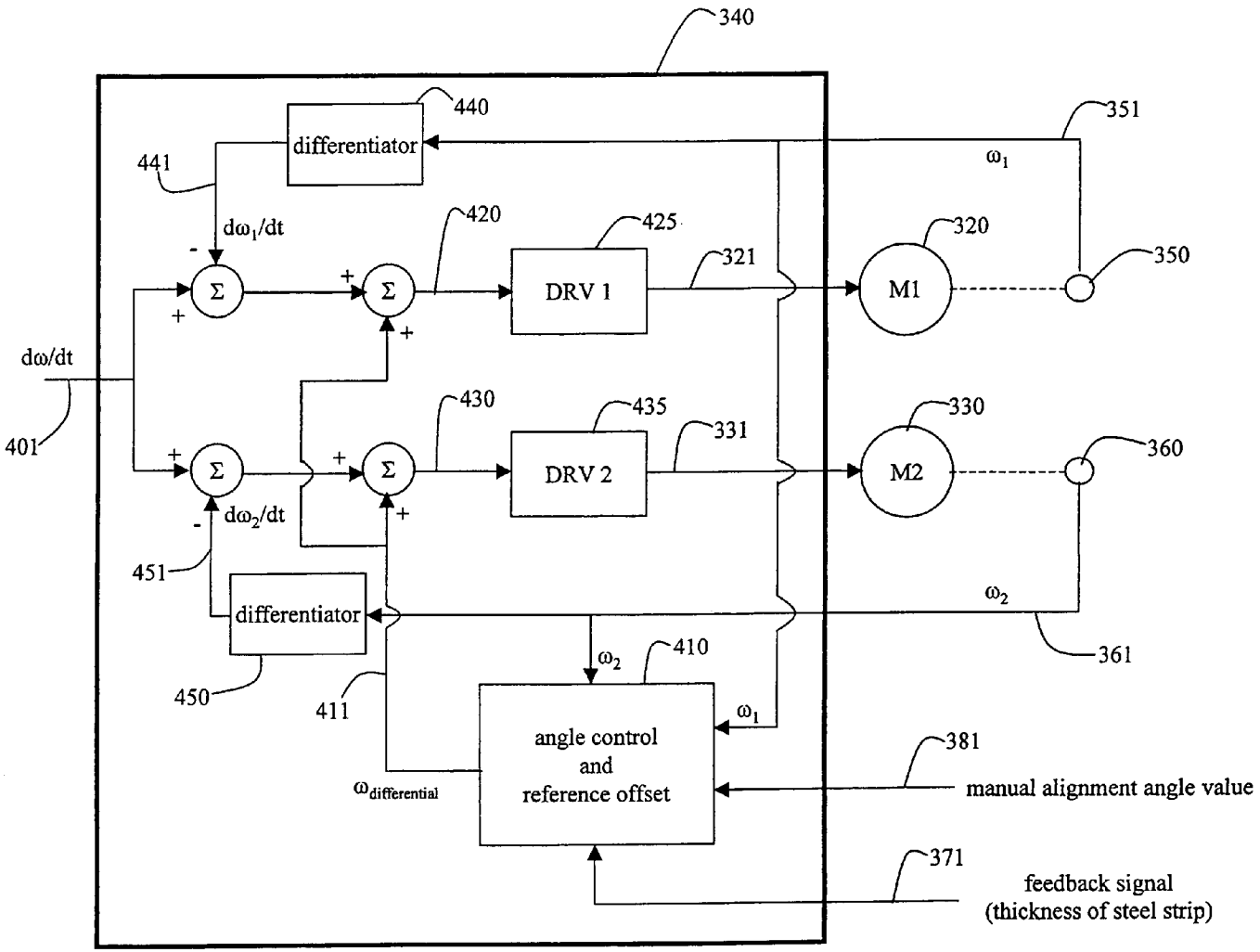
FIG. 4 is an schematic block diagram of an exemplary embodiment of the motor controller/driver mechanism of FIG. 3 for controlling the alignment angle of the casting rolls (shown in FIGS. 1, 2 and 3) while driving the casting rolls at a desired angular speed.

FIG. 4 is a schematic block diagram of one embodiment of the control circuit of the motor controller/driver mechanism 340 of FIG. 3 for controlling the alignment angle of the casting rolls 22 (shown in FIGS. 1, 2 and 3) while driving the casting rolls 22 at a desired angular speed. In addition to the motor controller/driver mechanism 340, FIG. 4 also shows the motors 320 and 330 and sensors 350 and 360 of FIG. 3. During operation, it is desirable to drive the casting rolls 22 at a selected (e.g., a desired) angular speed $d\omega/dt$ in a counter-rotating direction. A digital value signal or DC signal 401 is provided as an input to the motor controller/driver mechanism 340 to set the desired angular speed $d\omega/dt$ of the casting rolls 22. Sinusoidally alternating electrical signals 351 ($\omega$1) and 361 ($\omega$2) are fed back from sensors 350 and 360 to differentiators 440 and 450 respectively within the motor controller/driver mechanism 340. The electrical signals 351 and 361 represent the angular rotational positions of the motors 320 and 330 (or shafts 311 and 312), with respect to some reference position, as the casting rolls 22 rotate between 0 and 360 degrees in a repetitive, counter-rotating direction.

The differentiator 440 takes the electrical signal 351 and generates a signal 441 representing the actual angular speed $d\omega_1/dt$ of the rotating drive shaft 311. Similarly, the differentiator 450 takes the electrical signal 361 and generates a signal 451 representing the actual angular speed $d\omega_2/dt$ of the rotating drive shaft 312. The two signals 441 and 451 are subtracted from the desired angular speed value $d\omega/dt$.

Also, the alternating electrical signals 351 ($\omega_1$) and 361 ($\omega_2$) are used by the motor angle control and reference offset mechanism 410 of the controller/driver mechanism 340 to generate a differential angle signal $\omega_{differential}$ 411 which, in general, represents the angular difference ($\omega_1-\omega_2$) between the two casting rolls 22 at any given time. For example, if the manual alignment angle value 381 is set to zero degrees, then ideally $\omega_1=\omega_2$ and $\omega_1-\omega_2=0$. The motor controller/driver mechanism 340 will try to maintain $\omega_1=\omega_2$ as the casting rolls 22 counter-rotate with respect to each other. If the casting strip sensor 370 senses eccentricity of the casting rolls 22 in the thickness of the casting strip 12, then the feedback signal 371 will become non-zero and cause $\omega_1$ to deviate from $\omega_2$ to attempt to correct for the eccentricity (e.g., $\omega_{differential}$ 411 will become non-zero). The $\omega_{differential}$ 411 signal is added to both drive channels of the motor controller/driver mechanism 340. The resultant signals 420 and 430 are input to the driver circuitry 425 and 435 respectively. In accordance with an embodiment of the present invention, the driver system (circuitry 425 and 435) generate 3-phase current signals 321 and 331 respectively to provide torque to the motors 320 and 330 respectively.

In general, the motor controller/driver mechanism 340 will attempt to maintain the set angular speed $d\omega/dt$ of the casting rolls. However, if the two casting rolls 22 start to get out of angular alignment with each other, then the motor controller/driver mechanism 340 will slightly increase the angular speed of one motor (e.g., M1 320) and slightly decrease the angular speed of the other motor (e.g., M2 330) until the two casting rolls 22 come back into angular alignment. Angular alignment may be defined as $\omega_1=\omega_2$, or $\omega_1$ being offset from $\omega_2$ by some non-zero alignment angle, in order to counter the effects of eccentricities between the casting rolls.

The signal 420 going into DRV #1 425 is proportional to $d\omega/dt-d\omega_1/dt+\omega_{differential}$ and the signal 430 going into DRV #2 435 is proportional to $d\omega/dt-d\omega_2/dt+\omega_{differential}$. For example, if it is desirable to keep $\omega_1=\omega_2$ (i.e., $\omega_{differential}=0$), then when $\omega_1=\omega_2$, signal 420 equals signal 430 into the two drives 425 and 435 respectively. However, if $\omega_1$ starts to become slightly greater than $\omega_2$ as the casting rolls 22 counter-rotate, then the signal 420 will become slightly less than it was when $\omega_1=\omega_2$ and the signal 430 will become slightly greater than it was when $\omega_1=\omega_2$. As a result, the angular speed of the motor M1 320 will slightly decrease and the angular speed of the motor M2 330 will slightly increase, until $\omega_1$ becomes equal to $\omega_2$ once again. As $\omega_1$ and $\omega_2$ again stabilize to equal each other, the angular speed of each casting roll stabilizes again to the desired angular speed, $d\omega/dt$.

Similarly, if $\omega_2$ starts to become slightly greater than $\omega_1$ as the casting rolls 22 counter-rotate, then the signal 430 will become slightly less than it was when $\omega_1=\omega_2$ and the signal 420 will become slightly greater than it was when $\omega_1=\omega_2$. As a result, the angular speed of the motor M1 320 will slightly increase and the angular speed of the motor M2 330 will slightly decrease, until $\omega_1$ becomes equal to $\omega_2$ once again. As $\omega_1$ and $\omega_2$ again stabilize to equal each other, the angular speed of each casting roll stabilizes again to $d\omega/dt$. In this way, the angular phase relationship between the two casting rolls 22 is maintained.

The manual alignment value 381 and/or the feedback signal 371 allow for the casting rolls 22 to become stabilized at some other alignment angle with respect to each other to correct for eccentricities in the casting rolls 22. For example, the feedback signal 371 may indicate a sinusoidal variation in the thickness of the casting strip 12 being produced, which is of an unacceptable variation level. As a result, the angle control and reference offset mechansim 410 modifies $\omega_{differential}$ such that the alignment angle between the two casting rolls 22 gradually becomes, for example, 14 degrees, thus reducing the variation level by, for example, 70%. The motor controller/driver mechanism 340 will now try to maintain the alignment angle at 14 degrees (i.e., the two casting rolls 22 are now 14 degrees out of phase with each other as they counter-rotate at $d\omega/dt$).

In general, the various electrical signals and circuits described herein may be digital, analog, or some combination of digital and analog types, in accordance with various embodiments of the present invention.

Figure 5:
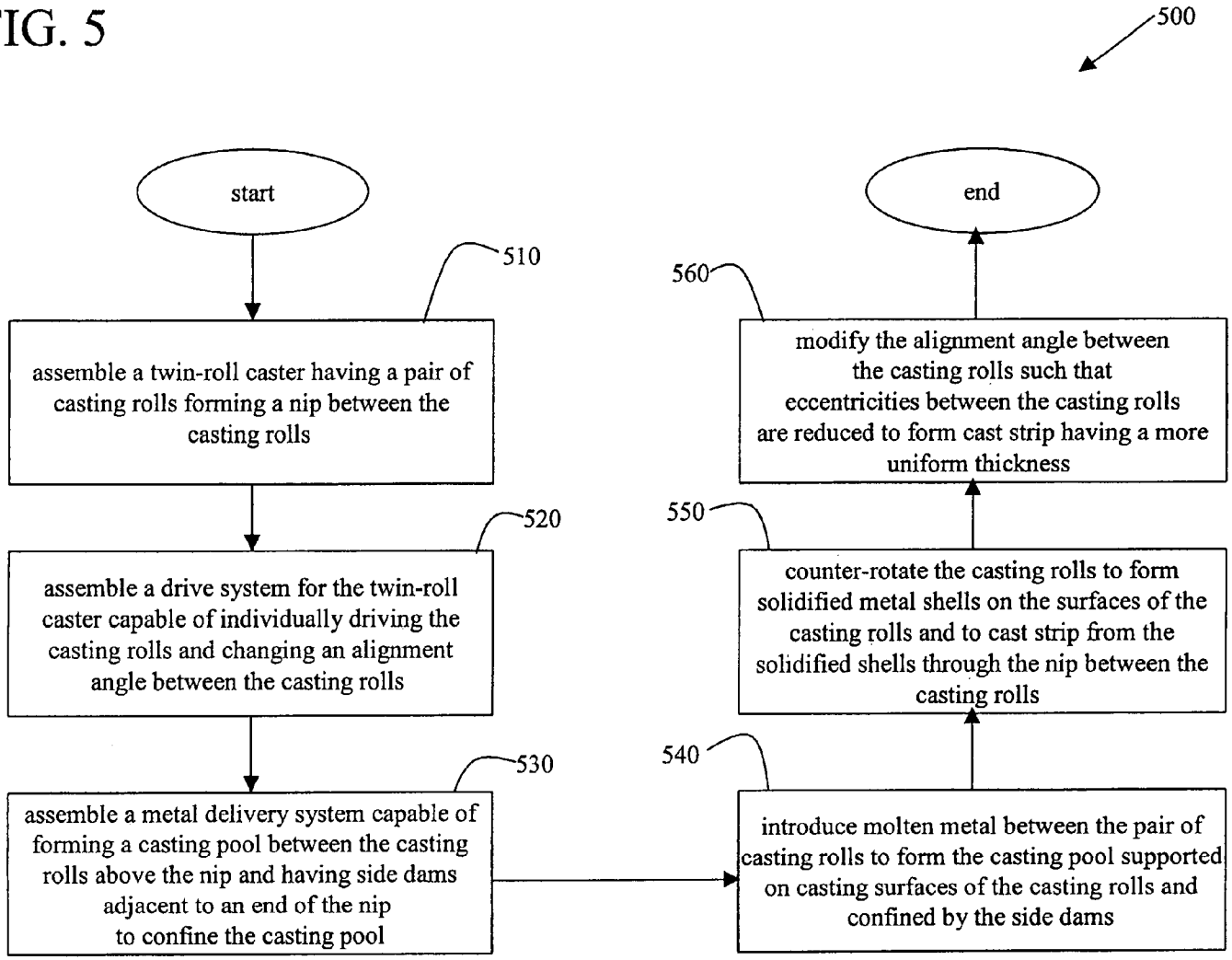
FIG. 5 is a flowchart of an embodiment of a method of producing thin cast strip by continuous casting using the thin strip casting plant shown in FIGS. 1–4.

FIG. 5 is a flowchart of an embodiment of a method 500 of producing thin cast strip by continuous casting using the thin strip casting plant 5 shown in FIGS. 1–4. In step 510, a twin-roll caster is assembled having a pair of casting rolls forming a nip between the casting rolls. In step 520, a drive system for the twin-roll caster is assembled which is capable of individually driving the casting rolls and changing an alignment angle between the casting rolls. In step 530, a metal delivery system is assembled which is capable of forming a casting pool between the casting rolls above the nip and having side dams adjacent to an end of the nip to confine the casting pool. In step 540, a molten metal is introduced between the pair of casting rolls to form the casting pool supported on the casting surfaces of the casting rolls and confined by the side dams. In step 550, the casting rolls are counter-rotated to form solidified metal shells on the surfaces of the casting rolls and to cast strip from the solidified shells through the nip between the casting rolls. In step 560, the alignment angle between the casting rolls is modified such that eccentricities between the casting rolls are reduced to form cast strip having a more uniform thickness.

Figure 6:
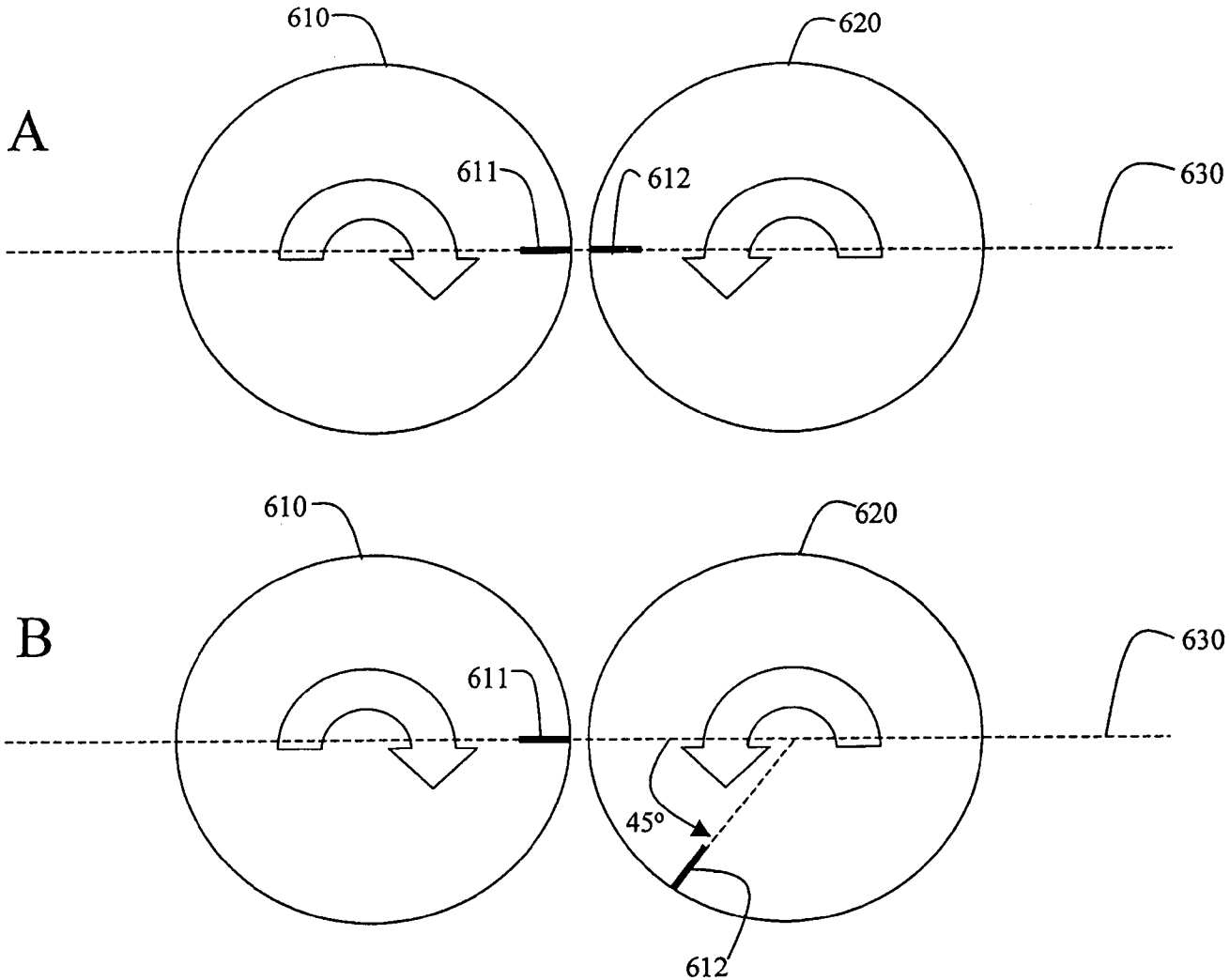
FIG. 6 is an exemplary illustration of the angular phase relationship of two casting rolls, in accordance with an embodiment of the present invention.
Figure 7:
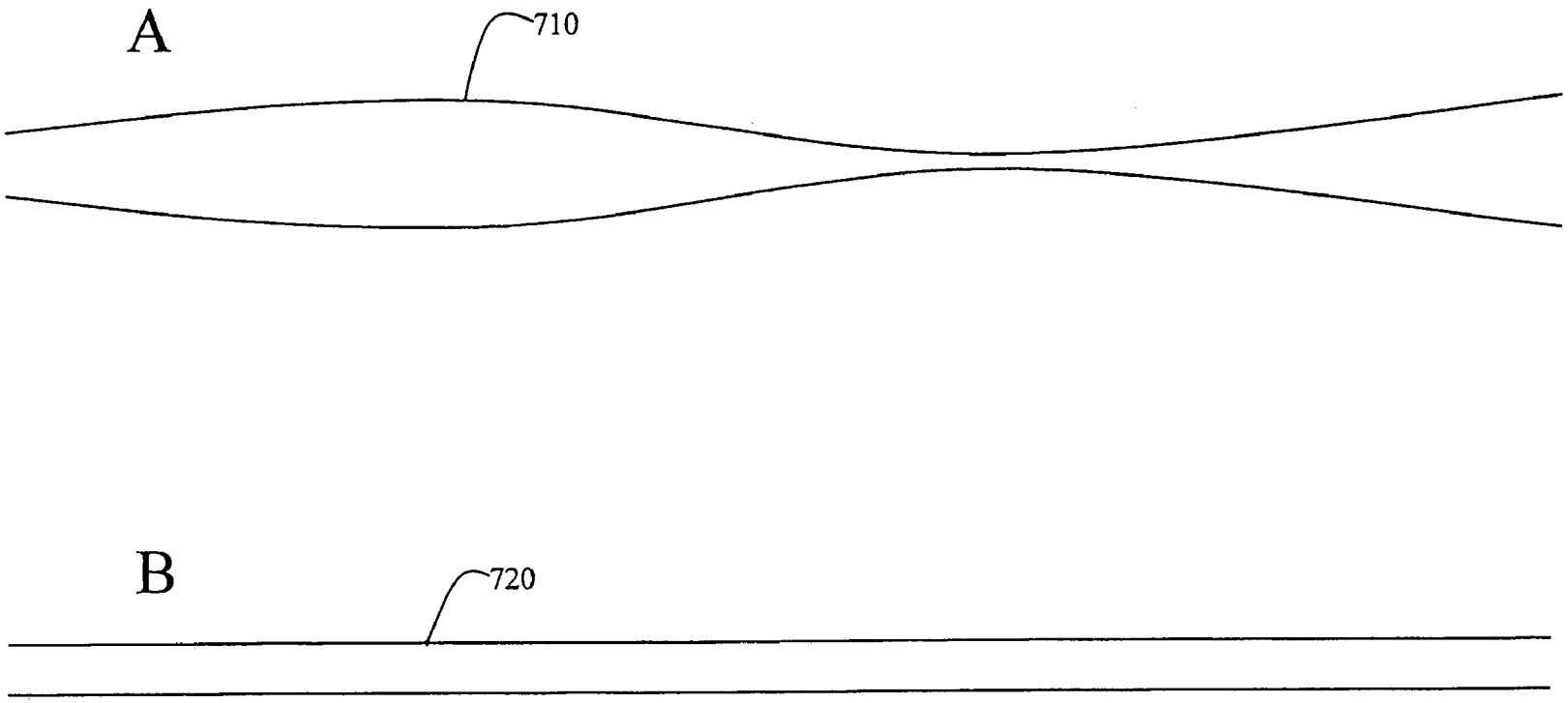
FIG. 7 is an exemplary illustration of segments of casting strip formed using the casting rolls of FIG. 6, in accordance with an embodiment of the present invention.

FIG. 6 and FIG. 7 illustrate an example of how the system of FIGS. 1–4 and the method of FIG. 5 may be used to correct for variations in the thickness of cast strip due to eccentricities in the casting rolls, in accordance with an embodiment of the present invention. FIG. 6A shows two casting rolls 610 and 620 that counter-rotate with respect to each other (see curved arrows). Each casting roll 610 and 620 is marked with a hash mark 611 and 612, for illustrative purposes, indicating the predefined zero degree (or 360 degree) angular position of the casting roll. It can be seen from FIG. 6A that the two casting rolls 610 and 620 are angularly aligned (i.e., phased) such that the two hash marks 611 and 612 always appear at the same angular rotational position with respect to an imaginary reference line 630 (i.e., $\omega_1=\omega_2$) as the two casting rolls counter-rotate. That is, the alignment angle is zero degrees.

FIG. 7A shows an illustrated segment of casting strip 710 which results from the counter-rotating casting rolls of FIG. 6A. As can be seen, there is significant variation in the thickness profile across the length of the casting strip 710 due to eccentricities between the casting rolls 610 and 620. In accordance with an embodiment of the present invention, a casting strip sensor (e.g., 370 of FIG. 3) can sense the variations in thickness of the casting strip 710 and provide a representative feedback signal (e.g., 371 of FIG. 3) to motor controller/driver mechanism (e.g., 340 of FIG. 3) to try to adjust out some, if not all, of the observed variations in thickness.

As an example, referring to FIG. 6B, the feedback signal is used by the motor controller/driver mechanism to adjust the angular phase relationship (i.e., the alignment angle) between the first casting roll 610 and the second casting roll 620 such that the predefined zero degree angular rotational position 612 of casting roll 620 leads the predefined zero degree angular rotational position 611 of casting roll 610 by 45 degrees. As a result, FIG. 7B shows a segment of casting strip 720 which results from the counter-rotating casting rolls of FIG. 6B, having the new 45 degree alignment angle. As can be seen, the variations in the thickness have been eliminated (i.e., the thickness profile of the segment of casting strip 720 is uniform). Such angular phase adjustments may be continuously and automatically performed during casting as the eccentricities between the two casting rolls continuously change due to various factors such as, for example, temperature variations on the surfaces of the casting rolls.

In summary, the drive systems of two casting rolls may be individually controlled, in accordance with various embodiments of the present invention, to reduce variations in thickness profiles of thin cast strip. The angular relationship between the two casting rolls is controlled to maintain and/or modify the angular relationship as the two casting rolls counter-rotate with respect to each other. Such individual control allows more uniform casting strip to be produced without damaging the resultant casting strip or casting shells from which it is made.

What is claimed is:

1. A method of producing thin cast strip by continuous casting, said method comprising:

assembling a twin-roll caster having a pair of casting rolls forming a nip between said casting rolls;

assembling a drive system for said twin-roll caster capable of individually driving said casting rolls and maintaining an alignment angle between said casting rolls;

assembling a metal delivery system capable of forming a casting pool between said casting rolls above said nip and having side dams adjacent to an end of the nip to confine said casting pool;

introducing molten metal between said pair of casting rolls to form said casting pool supported on casting surfaces of said casting rolls and confined by said side dams;

counter-rotating said casting rolls to form solidified metal shells on said surfaces of said casting rolls and to cast strip from said solidified shells through said nip between said casting rolls; and modifying said alignment angle between said casting rolls such that eccentricities between said casting rolls are reduced to form cast strip having a more uniform thickness.

2. The method of claim 1 wherein sensors, capable of sensing eccentricities in at least one casting surface of said casting rolls and generating electrical signals indicating an extent of said eccentricities in said at least one casting surface of said casting rolls, are provided, and wherein a controller is provided which is capable of varying said alignment angle to reduce a variation in shape of said strip due to said eccentricities in said at least one casting surface of said casting rolls.

3. The method of claim 1 wherein said drive system comprises at least two independent 3-phase AC motors.

4. The method of claim 2 wherein said controller includes at least one control circuit which uses signals corresponding to at least desired angular speed of said casting rolls and angular rotational position of said casting rolls to generate control signals which are used to individually drive said casting rolls in an angular phase relationship to each other.

5. A twin-roll casting apparatus for producing thin cast strip comprising:

a pair of casting rolls positioned laterally adjacent each other to form a nip between said casting rolls through which metal strip may be continuously cast;

a drive mechanism for said casting rolls capable of individually driving the rotational speed of said casting rolls in a counter-rotational direction to cause said strip to pass through said nip between said casting rolls;

at least one sensor capable of sensing eccentricities in at least one casting surface of said casting rolls and generating electrical signals indicating said eccentricities in said at least one casting surface of said casting rolls; and a control mechanism capable of varying an alignment angle between said casting rolls to reduce an effect of eccentricities in said casting rolls on a profile of said strip produced by said casting rolls, said control mechanism varying said alignment angle between said casting rolls to reduce effects on said profile of said strip from eccentricities in said casting rolls measured by said sensors.

6. The twin-roll casting apparatus of claim 5 wherein said control mechanism is capable of varying said alignment angle between said casting rolls to automatically reduce effects on said profile of said strip from said eccentricities in said casting rolls in response to at least said electrical signals.

7. The twin-roll casting apparatus of claim 5 wherein said drive mechanism includes at least two independent 3-phase AC motors.

8. The twin-roll casting apparatus of claim 5 wherein said control mechanism includes at least one control circuit which uses signals corresponding to at least desired angular speed of said casting rolls and angular rotational position of said casting rolls to generate control signals which are used to individually drive said casting rolls in an angular phase relationship to each other.

9. The twin-roll casting apparatus of claim 5 further comprising at least one sensor capable of sensing angular rotational positions of said casting rolls and generating electrical signals indicating said angular rotational positions of said casting rolls, and wherein said control mechanism and said drive mechanism generate independent drive signals for each of said casting rolls in response to at least said electrical signals.

* * * * *